United States Patent [19]

Geeting

[11] 4,364,441

[45] Dec. 21, 1982

[54] HOLE CLEANING DEVICE FOR AUGERS

[75] Inventor: Marvin D. Geeting, Fort Wayne, Ind.

[73] Assignee: States Engineering Corporation, Fort Wayne, Ind.

[21] Appl. No.: 206,070

[22] Filed: Nov. 12, 1980

[51] Int. Cl.[3] ..... C21B 10/44

[52] U.S. Cl. ..... 175/84; 175/207; 175/394

[58] Field of Search ..... 175/84, 88, 207, 313, 175/316, 394

[56] References Cited

U.S. PATENT DOCUMENTS

| | | | |
|---|---|---|---|
| 1,107,927 | 8/1914 | Fuchs | 175/394 |
| 2,061,218 | 11/1936 | Watson | 175/207 X |
| 2,321,680 | 6/1943 | Houston | 175/207 X |
| 2,709,572 | 5/1955 | Ageborn | 175/207 X |
| 2,783,974 | 3/1957 | Veasman | 175/394 X |
| 2,887,300 | 5/1957 | Meredih | 175/394 X |

OTHER PUBLICATIONS

Brochure "Hydraulic Augers by McMillen", published by the McMillen Division of States Engineering Corporation (Form 155 Revised 9-1-78).

*Primary Examiner*—William F. Pate, III

*Attorney, Agent, or Firm*—Gust, Irish, Jeffers & Hoffman

[57] ABSTRACT

A hole cleaning device which may be attached to the top of an auger or auger extension for rotation therewith includes two diametrically opposed blades arranged to resemble one flight of an auger, the outside diameter of the blades being suitably larger than the hole-digging auger itself. The two blades are secured to a mounting sleeve adapted to be secured to the upper end of the auger tube which supports the auger or to the top auger collar. To the top sides of the two blades are secured two elongated and radially extending deflecting elements, these being arcuately shaped and upstanding. As a hole is being drilled into the soil, the displaced soil is lifted and deposited onto the surface of the ground in an area around the hole. When the hole is drilled to full depth, the cleaning blades engage the soil build up, lifting and throwing it radially outwardly. For slow auger speeds, the loose soil is stacked in an annular pattern spaced from the hole. For higher auger speeds, the soil is dispersed up and away from the hole top.

7 Claims, 7 Drawing Figures

HOLE CLEANING DEVICE FOR AUGERS

BACKGROUND OF THE INVENTION

1. Field of the Invention

The present invention relates to hole-digging augers and more particularly to a cleaning device which clears loose soil away from the top of the hole upon completion of the digging thereof.

2. Description of the Prior Art

Hole-digging augers are conventional and there are various designs depending upon the type of digging to be performed. It is not unsual in the process of digging the hole for the loose soil which is elevated and deposited on top of the ground in an area around the hole to fall back when the auger is lifted out of the hole thus requiring additional labor not only to clear the soil which has fallen back but also that which surrounds the hole. Various means have been provided in the past for clearing the loose soil around the hole, typical of such an arrangement being disclosed in U.S. Pat. No. 2,321,680. Other auger arrangements are disclosed in U.S. Pat. Nos. 1,107,927; 1,523,143; 2,061,218; 2,490,471; 2,645,457; 2,709,572; 2,887,300; 3,043,382; 3,709,572 and 3,747,697.

SUMMARY OF THE INVENTION

The cleaning device of this invention is in form similar to that of one flight of an auger with the outside diameter being suitably larger than the auger to which it is attached. The cleaning device includes two diametrically opposed blades which are inclined. To the top sides of the two blades are two arcuately shaped, upstanding deflecting elements which are elongated and extend radially outwardly from the auger shaft. The cleaning device is adapted to rotate with the auger. As the hole is being drilled into the soil, the displaced soil is lifted and deposited onto the surface of the ground in an area around the hole. When the hole is drilled to about full depth, the cleaning blades engage the top portion of the loose buildup, lifting and moving the soil radially outwardly. When the blades descend to the surface of the ground, an annular area around the top of the hole is cleaned. For slow speeds of the auger, the loose soil is stacked neatly in an annular area around the top of the hole. For faster speeds, the loose soil is thrown outwardly away from the hole.

More generally, this invention provides a cleaning device for a hole-digging auger which includes a supporting carrier adapted to be mounted for rotation about a given axis. A generally planar blade is secured to and radially extends from the carrier for rotation therewith. The balde generally lies in a first plane which forms an angle other than a right angle with the aforesaid axis and has a leading edge which extends radially outwardly from the same axis. An upstanding deflecting surface on the blade which extends radially outwardly from the carrier and is angularly spaced from the leading edge serves in deflecting loose soil radially outwardly as the blade is rotated. The carrier is adapted to be secured to the shaft of the auger.

The two blades of a two-blade device may be included in an integrated assembly or may be separable at the carrier which may be in the form of a split collar.

In view of the foregoing, it is an object of this invention to provide for an improved hole-cleaning devices for use in conjunction with hole-digging augers.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
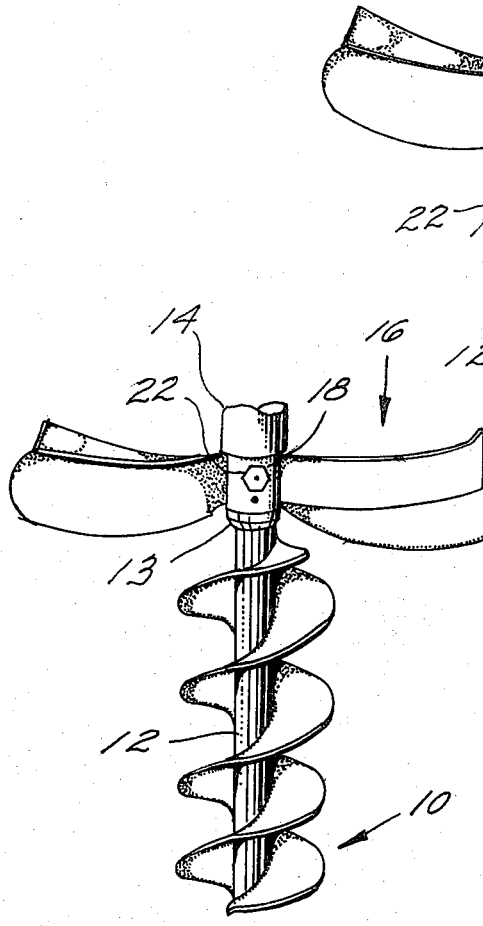
FIG. 1 is a fragmentary side view of a conventional auger having a cleaning device of this invention secured to the upper end thereof.
Figure 2:
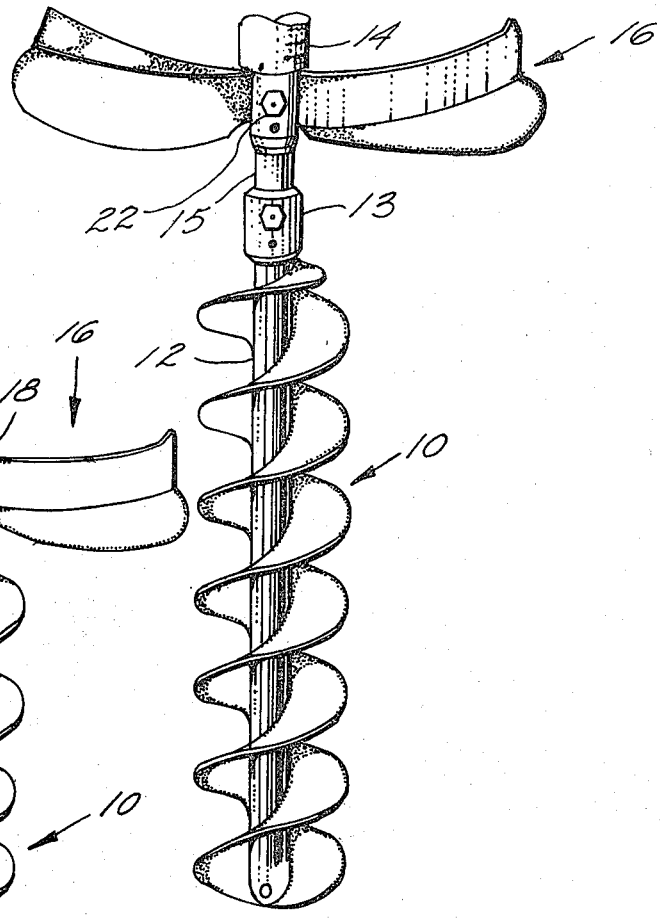
FIG. 2 is a similar view but showing the hole cleaning device secured to an auger extension shaft.

Referring to the drawings, there is shown in FIGS. 1 and 2 a conventional auger 10 on a tube 12 which is carried by a collar 13 adapted to be secured at its upper end to a suitable apparatus 14 whereby the auger 10 may be manipulated vertically and also rotated. FIG. 2 shows a shaft extension 15 received by tube 12. A hole cleaning device 16 is secured to the upper end of the auger to rotate therewith, this device including a sleeve 18 having an opening 20 adapted to receive a threaded fastener or the like 22 for securing the sleeve 18 to the collar 12 or extension shaft 15 for rotation therewith. The cleaning device 16 is in form similar to that of one flight of an auger with the outside diameter being suitably larger than the auger 10 itself. The cleaning device includes two diametrically opposed metal blades which generally lie in planes inclined to the rotation of the sleeve 18. More particularly, the blades 24 generally conform to right angle segments of a disc with the leading edges 28 thereof being straight and in alignment and otherwise coinciding with the diameter of the sleeve 18. Still further, these leading edges 28 are preferably coplanar for a purpose which will be explained in detail hereinafter. The trailing edges 30 are also coplanar with a diameter of the sleeve 18 and are inclined at an angle of almost 16° to the axis of sleeve 18.

To the upper surfaces of the two blades 24 are welded two elongated, flat metal strips which extend generally radially outwardly from the sleeve 18 at the locations shown to the aft, outer corner of the blades. These strips 32 are set essentially at right angles to the upper surfaces of the respective blades 24 and are arcuately curved as shown with the convex sides thereof facing forwardly, or in other words toward the respective leading edges 28. As such, the strips 32 are considered to be deflecting elements.

Figure 3:
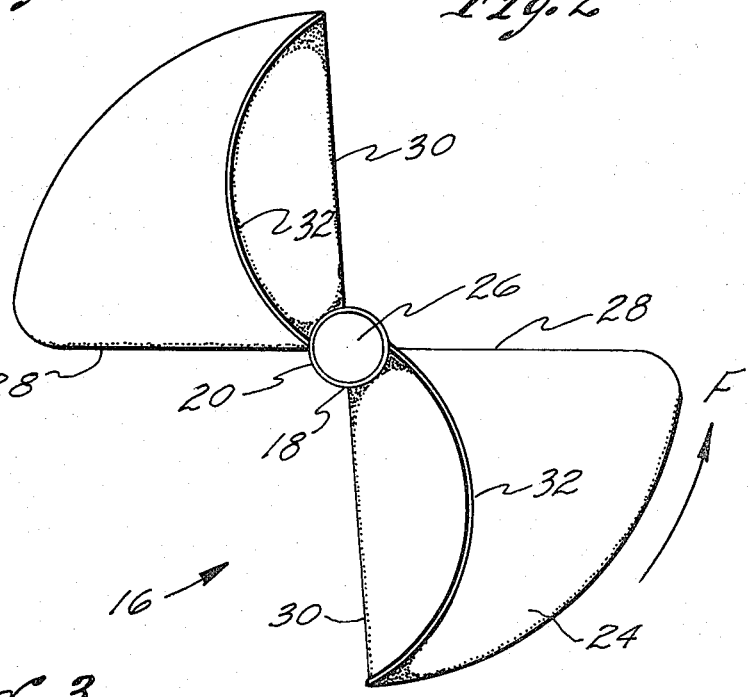
FIG. 3 is a top plan view of one embodiment of the hole cleaning device.
Figure 4:
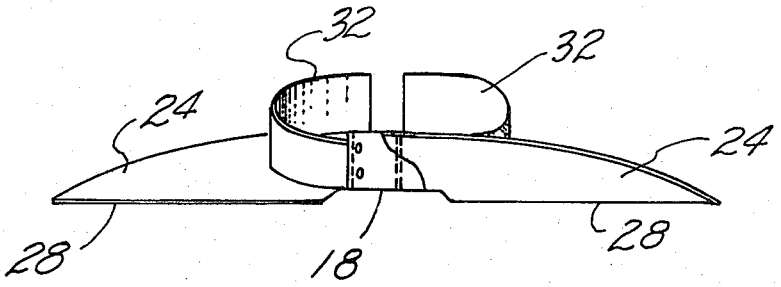
FIG. 4 is a side view thereof.
Figure 7:
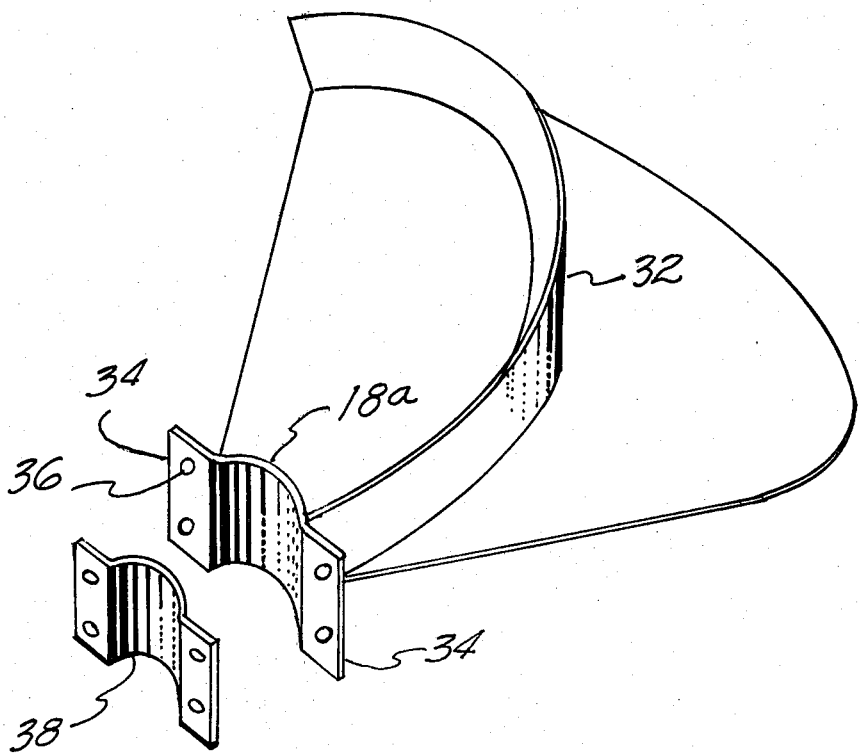
FIG. 7 is a perspective of another embodiment of this invention.

While the blades 24 and deflecting elements 32 of FIGS. 2 and 3 are rigidly secured into a single assembly, preferably by welding, the device may be made in two separable units, one unit being shown in FIG. 7. In this instance, the sleeve 18 is made in two halves **18*a* having flat, diametral flanges 34. These flanges 34 are provided with holes 36 for receiving threaded fasteners. Shims 38 which complement the shape of the sleeve half 18***a* may be employed for adapting the cleaner to smaller auger shafts collars (or shafts). With two complementing units such as shown in FIG. 7, these may be bolted or otherwise clamped onto an auger collar 13 or shaft 15 for rotation therewith. Shim 38 may then be tack welded for ease of future application and removal of cleaning device 16.

As mentioned previously, the blades 24 generally conform to the configuration and pitch of one flight of an auger with the leading edges 28 coplanar at right angles to the auger axis. Thus formed, the blades 24 generally lie in a plane which forms an acute angle with the axis of the auger tube 12 and the sleeve 18.

In use, the auger 10 is driven downwardly while being rotated for the purpose of digging a hole into the ground. As the hole is being drilled, the displaced soil is lifted and deposited onto the top of the ground in an area around the hole. When the hole is drilled to about full depth, the cleaning blades 24 and deflecting elements 32 engage the top portion of the loose soil buildup, lifting and moving it radially outwardly. When the blades descend to the surface of the ground, an annular area around the top of the hole is cleaned as shown more clearly in FIG. 5. Thus, when the auger is lifted out of the hole, loose soil does not fall back thereinto.

Figure 5:
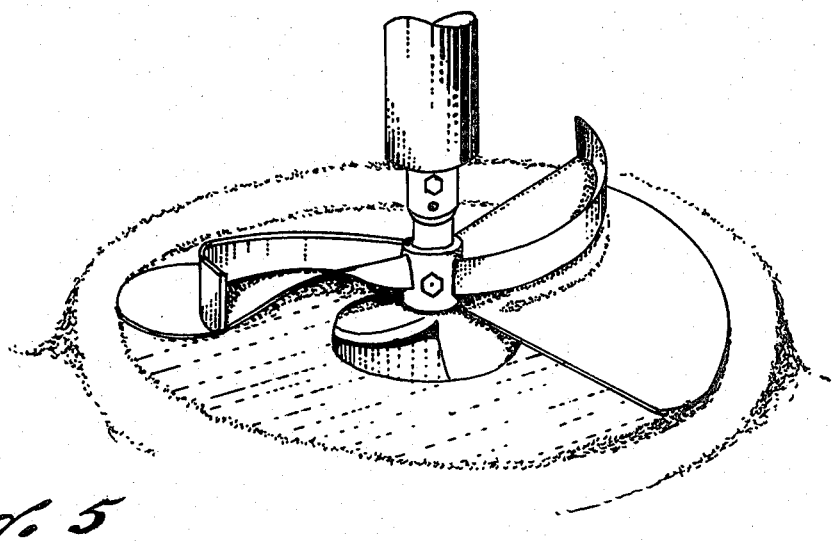
FIG. 5 is a perspective view of the device of this invention in use with the auger partially drilled into the ground.
Figure 6:
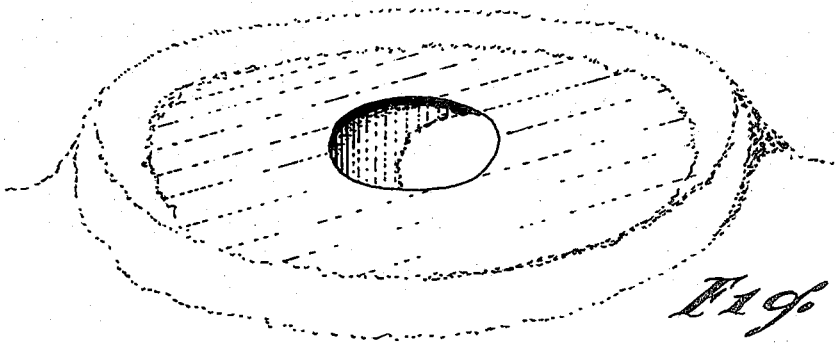
FIG. 6 is a view showing the completed hole with the loose soil stacked in an annular pattern surrounding the hole.

Using slower speeds, rotation of the auger and the cleaning device stacks loose soil in an annular pattern away from the hole as shown in FIG. 5. Higher auger rotational speeds disperse the soil and other debris up and away from the hole top, thereby eliminating soil handling labor and the attendant costs. The time consuming job of cleaning the hole is eliminated and the walls and bottom remain packed tightly under most soil conditions.

Since the leading edges 28 are coplanar, with the rotation of the blades 24 in the direction of the arrow "F" as shown in FIG. 2, as the blades descend, the loose soil engaged by the leading edges 28 is elevated by the upwardly inclined surfaces of the blades 24. This soil is engaged by the deflecting elements 32 and thereby directed radially outwardly off the blades 24 into the annular pile shown in FIG. 5.

It is well known that in the use of conventional augers, buildup of soil and debris around the edge of the hole during the drilling operation remains there after the auger is removed from the hole. A portion of this same soil can fall back into the hole which requires another operation and additional labor to effect the removal thereof. By use of the present invention, this further operation and labor are eliminated.

While there have been described above the principles of this invention in connection with specific apparatus, it is to be clearly understood that this description is made only by way of example and not as a limitation to the scope of the invention.

What is claimed is:

1. A cleaning device for a hole-digging auger comprising a supporting carrier adapted to be mounted for rotation about a given axis, a generally planar blade secured to and radially extending from said carrier for rotation therewith, said blade generally lying in a first plane inclined to said axis and having a leading edge which extends radially outwardly from said axis, and an upstanding deflecting surface on said blade which extends radially outwardly from said carrier and is angularly spaced from said leading edge, whereby rotation of said carrier causes said blade to elevate loose soil from a plane including said leading edge and said deflecting surface to deflect the elevated soil radially outwardly, said blade being a segment of a screw flight and said deflecting surface being carried by an elongated metal strip secured along one edge to said blade, said elongated metal strip being arcuately shaped with the convex surface thereof being toward said leading edge.

2. The cleaning device of claim 1 wherein said leading edge extends substantially at right angles to said axis, said blade being in the general form of a quarter segment of a disc, and said elongated strip extending between said carrier adjacent to said leading edge and the outer periphery of said blade.

3. The cleaning device of claim 2 wherein said surface in the region radially adjacent to said carrier forms an acute angle with said leading edge and in the region outwardly thereof curves generally away from said leading edge to form an acute angle with the perimeter of said quarter segment.

4. The cleaning device of claim 3 wherein said carrier is a collar, and said blade having a straight trailing edge.

5. The device of claim 4 including two such blade and strip assemblies in diametrically opposed relation, the leading edges of said blades lying in a common plane along a common imaginary line at right angles to said axis of rotation.

6. The device of claim 5 wherein said collar is diametrically split with one-half each being secured to a respective one of said blades, two flanges on said collar halves for receiving threaded fasteners to secure said halves together.

7. The device of claim 5 in combination with an auger having a mounting shaft, said blade device being mounted on the upper end of said auger and having said collar secured to said shaft with the first-mentioned axis coinciding with the shaft axis, the outer diameter of the cleaning device being larger than that of the auger.

* * * * *